US012173953B2

(12) United States Patent
Zhu et al.

(10) Patent No.: US 12,173,953 B2
(45) Date of Patent: Dec. 24, 2024

(54) REFRIGERATOR

(71) Applicants: QINGDAO HAIER REFRIGERATOR CO., LTD., Shandong (CN); HAIER SMART HOME CO., LTD., Shandong (CN)

(72) Inventors: Xiaobing Zhu, Qingdao (CN); Jianru Liu, Qingdao (CN); Mengcheng Li, Qingdao (CN); Shanshan Liu, Qingdao (CN); Dongqiang Cao, Qingdao (CN); Yang Liu, Qingdao (CN); Yunxi Liu, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 247 days.

(21) Appl. No.: 17/642,310

(22) PCT Filed: Sep. 9, 2020

(86) PCT No.: PCT/CN2020/114260
§ 371 (c)(1),
(2) Date: Mar. 11, 2022

(87) PCT Pub. No.: WO2021/047552
PCT Pub. Date: Mar. 18, 2021

(65) Prior Publication Data

US 2022/0341651 A1 Oct. 27, 2022

(30) Foreign Application Priority Data

Sep. 12, 2019 (CN) ..... 201910865909.6
Sep. 12, 2019 (CN) ..... 201921521971.5
Sep. 12, 2019 (CN) ..... 201921521983.8

(51) Int. Cl.
*F25D 21/14* (2006.01)
*F25D 17/06* (2006.01)
*F25D 23/00* (2006.01)

(52) U.S. Cl.
CPC ..... *F25D 21/14* (2013.01); *F25D 17/065* (2013.01); *F25D 23/006* (2013.01);
(Continued)

(58) Field of Classification Search
CPC ..... F25D 21/14; F25D 17/065; F25D 23/006; F25D 2321/1413; F25D 2321/143;
(Continued)

(56) References Cited

U.S. PATENT DOCUMENTS 2,175,946 A * 10/1939 Smith ..... F24F 1/022 62/506
2,691,536 A * 10/1954 Tamminga ..... F16L 19/0218 285/392

(Continued)

FOREIGN PATENT DOCUMENTS

CN 101210761 A 7/2008
CN 102213528 A 10/2011

(Continued)

OTHER PUBLICATIONS

EP-1731860-A2 machine translation (Year: 2024).*

(Continued)

*Primary Examiner* — Eric S Ruppert
*Assistant Examiner* — Kirstin U Oswald
(74) *Attorney, Agent, or Firm* — Alston & Bird LLP

(57) ABSTRACT

A refrigerator comprises: a refrigerator body (10), at the interior of which a cooling chamber (11) and at least one storage space are confined, wherein the cooling chamber (11) is arranged at the bottom of the refrigerator body (10) and below the storage space; door bodies (20) arranged on (Continued)

a front surface of the refrigerator body (10) to operably open and close the storage space; and an evaporator (21), which is wholly horizontally placed in the shape of a flat cube in the cooling chamber (11) and configured to provide cold energy to the storage space, wherein a bottom wall of the cooling chamber (11) below the evaporator (21) is provided with a water pan (40) to receive condensate water generated by the evaporator (21), and the bottom of the water pan (40) is provided with compensation heating wires (80).

14 Claims, 11 Drawing Sheets

(52) U.S. Cl.
CPC ..... *F25D 2321/1413* (2013.01); *F25D 2321/143* (2013.01); *F25D 2321/1441* (2013.01); *F25D 2321/146* (2013.01)

(58) Field of Classification Search
CPC ..... F25D 2321/1441; F25D 2321/146; F25D 2317/067; F25D 21/08; H05K 7/20318; H05K 7/20209; H05K 7/203; H05K 7/20327; H05K 7/20336; H05K 7/20381; H05K 7/20818
USPC ..... 62/150
See application file for complete search history.

(56) References Cited

U.S. PATENT DOCUMENTS

| | | | | | |
|---|---|---|---|---|---|
| 2,767,558 | A * | 10/1956 | Wallenbrock | F25D 25/024 | 62/505 |
| 2,909,910 | A * | 10/1959 | Saunders | F25D 21/14 | 62/277 |
| 2,994,207 | A * | 8/1961 | Preotle | F25D 21/008 | 62/155 |
| 3,050,957 | A * | 8/1962 | Robbie | F25D 21/14 | 62/277 |
| 3,099,914 | A * | 8/1963 | De Witt | F25D 21/14 | 62/289 |
| 3,252,292 | A * | 5/1966 | O'Connell | F25D 17/065 | 62/298 |
| 3,451,226 | A * | 6/1969 | Shriver | F25D 21/14 | 62/277 |
| 3,599,442 | A * | 8/1971 | Hanson | F25D 17/065 | 62/285 |
| 3,633,374 | A * | 1/1972 | Canter | G05D 23/2401 | 219/505 |
| 3,868,829 | A * | 3/1975 | Mann | F25D 21/14 | 62/288 |
| 4,462,216 | A * | 7/1984 | Kramer | F25D 21/14 | 137/59 |
| 6,442,956 | B1 * | 9/2002 | Herren | F24F 13/222 | 62/272 |
| 10,281,171 | B2 * | 5/2019 | Shaffer | F24H 4/04 | |
| 2002/0134088 | A1 * | 9/2002 | Rudick | F28D 15/0266 | 62/448 |
| 2003/0221439 | A1 * | 12/2003 | Bush | H01H 36/02 | 62/285 |
| 2004/0187947 | A1 * | 9/2004 | Heo | F16L 11/122 | 138/121 |
| 2006/0207280 | A1 * | 9/2006 | Avila | F25D 17/06 | 62/255 |
| 2009/0000326 | A1 * | 1/2009 | Bang | F25D 21/14 | 62/515 |
| 2012/0060531 | A1 * | 3/2012 | Ferreira | C02F 3/1263 | 62/150 |
| 2015/0192349 | A1 * | 7/2015 | Junge | F25D 21/14 | 62/291 |

FOREIGN PATENT DOCUMENTS

| | | | | | |
|---|---|---|---|---|---|
| CN | 107702417 | A | * | 2/2018 | |
| CN | 208475771 | U | | 2/2019 | |
| CN | 109751824 | A | | 5/2019 | |
| CN | 208817810 | U | | 5/2019 | |
| CN | 210832692 | U | | 6/2020 | |
| CN | 210832693 | U | | 6/2020 | |
| CN | 210832694 | U | | 6/2020 | |
| CZ | 102011002642 | A1 | * | 7/2012 | F25D 21/14 |
| DE | 1033686 | B | | 7/1958 | |
| DE | 10-2014-008683 | A1 | | 12/2015 | |
| DE | 102016213723 | A1 | * | 2/2018 | |
| EP | 0753710 | A2 | * | 1/1997 | |
| EP | 1731860 | A2 | * | 12/2006 | F25D 17/047 |
| GB | 701900 | A | | 1/1954 | |
| JP | S58219382 | A | | 12/1983 | |
| JP | H04344088 | A | | 11/1992 | |
| JP | 2002062034 | A | | 2/2002 | |
| JP | 2003050076 | A | * | 2/2003 | |
| JP | 2008-039250 | A | | 2/2008 | |
| JP | 2008185243 | A | * | 8/2008 | |
| JP | 2018066545 | A | | 4/2018 | |
| KR | 2006-0008792 | A | | 1/2006 | |
| KR | 100859461 | B1 | * | 9/2008 | |
| KR | 2020100005939 | U | | 6/2010 | |
| KR | 2010078887 | A | * | 7/2010 | |
| KR | 2011021926 | A | * | 3/2011 | F25D 21/04 |
| KR | 20180011691 | A | | 2/2018 | |
| WO | WO-2017060066 | A1 | * | 4/2017 | F25D 21/08 |

OTHER PUBLICATIONS

KR-2010078887-A machine translation (Year: 2024).*
KR-2011021926-A machine translation (Year: 2024).*
DE-102011002642-A1 machine translation (Year: 2024).*
DE-102016213723-A1 machine translation (Year: 2024).*
WO-2017060066-A1 machine translation (Year: 2024).*
CN-107702417-A machine translation (Year: 2024).*
KR-100859461-B1 machine translation (Year: 2024).*
EP-0753710-A2 machine translation (Year: 2024).*
JP-2003050076-A machine translation (Year: 2024).*
JP-2008185243-A machine translation (Year: 2024).*
Notice of Acceptance for Australia Patent Application No. 20203246937 dated Aug. 22, 2023 (3 pages).
2nd Examination Report for Australia Patent Application No. 2020346937 dated May 15, 2023 (4 pages).
Notice of Intention to Grant for European Patent Application No. 20863546.6 dated Jul. 5, 2023 (42 pages).
1st Examination Report for Australia Patent Application No. 20203246937 dated Jan. 24, 2023 (4 pages).
1st Office Action for European Patent Application No. 20863546.6 dated Aug. 26, 2022 (7 pages).
2nd Office Action for European Patent Application No. 20863546.6 dated Jan. 18, 2023 (8 pages).
European Search Report for EP Application No. 20863546.6 dated Aug. 16, 2022 (4 pages).
International Search Report for PCT/CN2020/114260 (ISA/CN) mailed Dec. 2, 2020 with English translation (8 pages).
Written Opinion for PCT/CN2020/114250 mailed Dec. 2, 2020 (4 pages).
1st Office Action for China Patent Application No. 201910865909.6 dated Oct. 11, 2024, w/English translation (21 pages).

* cited by examiner

REFRIGERATOR

FIELD OF THE INVENTION

The present invention relates to the field of household appliances, and in particular, to a refrigerator.

BACKGROUND OF THE INVENTION

With the increasing development of society and the continuous improvement of people's living standards, people's life rhythm is getting faster and faster, and they may buy and reserve a lot of food at one time. In order to ensure the storage effect of food, a refrigerator has become one of the indispensable household appliances in people's daily life.

A refrigerator generally provides cold energy to the storage space by means of an evaporator, and the air whose temperature rises in the storage space returns to the evaporator, thus forming an air circulation. Due to the relatively high humidity of the air in the storage space, the air returning to the evaporator will cause frosting on the surface of the evaporator. When the frost layer is thick and wraps the entire evaporator, the refrigeration efficiency of the evaporator will be seriously affected. In order to solve the problem of frosting in the evaporator, the evaporator is often heated regularly in the prior art, so that the frost layer is turned into water and discharged. However, at present, complete defrosting cannot be guaranteed after the evaporator is heated for defrosting. Residual ice cubes may block a water outlet for discharging the defrosted water, thus affecting normal defrosting and further affecting the refrigeration efficiency of the evaporator.

BRIEF DESCRIPTION OF THE INVENTION

An objective of the present invention is to ensure that an evaporator is completely defrosted and improve the refrigeration efficiency of the evaporator.

A further objective of the present invention is to effectively use heat, save energy and protect the environment.

Another objective of the present invention is to provide a refrigerator that prevents hot and humid air from entering a cooling chamber from a drain pipe to cause serious frosting of the evaporator.

Another further objective of the present invention is to improve the use reliability of the refrigerator.

Still another objective of the present invention is to provide a refrigerator with a drain pipe that prevents a foaming material from overflowing into the cooling chamber.

A further objective of the present invention is to prevent the foaming material from overflowing into a compressor chamber.

In particular, the present invention provides a refrigerator, including:

a refrigerator body, at the interior of which a cooling chamber and at least one storage space are confined, wherein the cooling chamber is arranged at the bottom of the refrigerator body and below the storage space;

door bodies, arranged on a front surface of the refrigerator body to operably open and close the storage space; and an evaporator, wholly horizontally placed in the shape of a flat cube in the cooling chamber and configured to provide cold energy to the storage space, wherein a bottom wall of the cooling chamber below the evaporator is provided with a water pan for receiving condensate water generated by the evaporator, and compensation heating wires are arranged at the bottom of the water pan.

Optionally, the compensation heating wires with different densities are arranged in different areas of the bottom of the water pan;

a compressor chamber is also confined in the refrigerator body, and the compressor chamber is arranged at the bottom of the refrigerator body and located behind the cooling chamber;

the bottom of the water pan is divided into three areas from back to front: a first area, a second area and a third area, wherein the first area is close to the compressor chamber, the second area is located between the evaporator and the compressor chamber, and the third area is located below the evaporator.

Optionally, the first area is not provided with the compensation heating wires, but is attached with a thermally conductive material to conduct the heat of the compressor chamber;

the second area is provided with the compensation heating wires with a first density, and the third area is provided with the compensation heating wires with a second density, wherein the first density is less than the second density.

Optionally, there are a plurality of storage spaces, including a refrigeration space and at least one freezing space, and the refrigerator includes: a freezing liner, at the interior of which the cooling chamber and the at least one freezing space above the cooling chamber are confined, wherein a bottom wall of the freezing liner as the bottom wall of the cooling chamber is provided with the water pan; and a refrigeration liner, which is arranged above the freezing liner, and at the interior of which the refrigeration space is confined.

Optionally, the refrigerator further includes:

a return air duct, which is arranged on any side wall of the refrigeration liner and the freezing liner, the upper end of which is provided with a return air inlet communicated with the refrigeration space, and the lower end of which is provided with a return air outlet communicated with the cooling chamber to realize air return from the refrigeration space to the cooling chamber.

Optionally, the bottom of the water pan is further divided into a fourth area, the fourth area is located on a front side of the water pan and close to the return air outlet, and the fourth area is provided with the compensation heating wires.

Optionally, the refrigerator further includes:

an air supply duct, which is arranged on the inner sides of rear walls of the refrigeration liner and the freezing liner and has an air supply inlet communicated with the cooling chamber at a bottom end, and air supply outlets arranged corresponding to the refrigeration space and the freezing space respectively to transfer the cold energy provided by the evaporator to the storage spaces; and an evaporator cover plate, which covers the evaporator, and serves as a top wall to confine the cooling chamber together with the freezing liner, wherein a front end of the evaporator cover plate is provided with a freezing return air port communicated with the freezing space to realize air return from the freezing space to the cooling chamber.

Optionally, a water outlet is formed at the bottom of the water pan, and the refrigerator further includes:

an evaporating dish, arranged below the water pan; and a drain pipe, connected between the water outlet and the evaporating dish and used for guiding water in the water pan to the evaporating dish, wherein the part of the drain pipe extending into the evaporating dish includes an extension pipe section and an end pipe section connected to the extension pipe section and located at the end of the drain pipe, and the inner diameter of the end pipe section is 10% to 50% of the inner diameter of the extension pipe section, thereby reducing the size of the water outlet of the drain pipe.

Optionally, there is also a transition pipe section between the end pipe section and the extension pipe section, and the inner diameter of the transition pipe section is tapered in a drainage direction to form a funnel shape.

Optionally, a floating body is arranged in the extension pipe section above the transition pipe section, the shape of the bottom of the floating body is adapted to the shape of the inner diameter of the transition pipe section, and the density of the floating body is less than that of water, so that the floating body rises by means of the buoyancy of water to open the transition pipe section;

the end pipe section and the transition pipe section are both vertically arranged.

Optionally, a water storage portion is formed at the bottom of the water pan, and the end pipe section is inserted into the water storage portion, so that the discharged water fills the water storage portion and then overflows into the evaporating dish; and the refrigerator further includes:

a drain pump, connected to the drain pipe to pump water in the water pan into the evaporating dish; wherein the refrigerator body includes a storage liner, and the cooling chamber is located at the inner bottom of the storage liner;

a compressor chamber is further formed at a lower rear part of the storage liner, and the evaporating dish is arranged in the compressor chamber;

there is a thermal insulation layer between the cooling chamber and the compressor chamber, and the drain pipe obliquely passes through the thermal insulation layer and enters the compressor chamber.

Optionally, the entire evaporator is horizontally placed in the shape of a flat cube in the cooling chamber, and the refrigerator further includes: an air supply fan, located in the cooling chamber and obliquely arranged on the rear side of the evaporator, wherein the water outlet is located below a front part of the evaporator;

a ratio of the horizontal distance between the water outlet and a front end of the evaporator to the horizontal distance between the water outlet and a rear end of the evaporator is greater than ⅙ and less than ½.

Optionally, a water outlet is formed at the bottom of the water pan, and the refrigerator further includes:

an evaporating dish, arranged below the water pan; and a connecting seat, attached to the outer side of the bottom of the water pan, and connected with a drain pipe at a position opposite to the water outlet, wherein the drain pipe is used for guiding water in the water pan to the evaporating dish; and a protective sheet, attached to a connecting edge of the connecting seat and the water pan to prevent a foaming material from overflowing into the cooling chamber during foaming in the refrigerator body.

Optionally, the shape of the side of the connecting seat facing the water pan is adapted to the bottom of the water pan;

the protective sheet is made of an aluminum foil and attached to the connecting edge of the connecting seat and the water pan.

Optionally, the refrigerator body includes a storage liner, and the cooling chamber is located at the inner bottom of the storage liner;

a compressor chamber is further formed at a lower rear part of the storage liner, and the evaporating dish is arranged in the compressor chamber;

the drain pipe obliquely passes through a thermal insulation layer between the cooling chamber and the compressor chamber; and the drain pipe includes:

an upper section, an upper end of the upper section being fixed to the connecting seat and the upper section extending obliquely downward through the thermal insulation layer between the cooling chamber and the compressor chamber;

a bellows section, an upper end of the bellows section being connected to a lower end of the upper section and the bellows section extending to the evaporating dish; and a lower section, an upper end of the lower section being connected to a lower end of the bellows section, and the lower section being used for draining water into the evaporating dish; wherein the lower section includes:

an inclined connecting section, connected to the lower end of the bellows section and extending along the length of the bellows section, and a vertical water outlet section, connected to a lower end of the inclined connecting section and used for guiding water into the evaporating dish vertically.

Optionally, the refrigerator body further includes:

a back, located at the rear side of the storage liner; and a partition plate, extending obliquely forward from the back to form a top wall of the compressor chamber; the upper section passing out of a through hole of the partition plate and entering the compressor chamber, wherein the upper end of the bellows section is provided with a bayonet, the lower end of the upper section is provided with a chuck, and after the upper end of the bellows section is sleeved on the lower end of the upper section, the chuck is engaged with the bayonet, so that the bellows section is engaged with the upper section;

the upper section is provided with a flange and an external thread on both sides of the partition plate respectively; a fixing ring is arranged at the external thread in a matching manner, and the fixing ring is screwed with the external thread to press the partition plate between the flange and the fixing ring;

a gasket is further arranged on the side of the flange opposite to the partition plate to prevent the foaming material from overflowing into the compressor chamber during foaming in the refrigerator body.

The refrigerator of the present invention includes: a refrigerator body, at the interior of which a cooling chamber and at least one storage space are confined, wherein the cooling chamber is arranged at the bottom of the refrigerator body and below the storage space; door bodies arranged on the front surface of the refrigerator body to operably open and close the storage space; and an evaporator, which is wholly horizontally placed in the shape of a flat cube in the cooling chamber and configured to provide cold energy to the storage space, wherein the bottom wall of the cooling chamber below the evaporator is provided with a water pan to receive condensate water generated by the evaporator, and the bottom of the water pan is provided with compensation heating wires. In addition to the normal heating and defrosting of the evaporator, the compensation heating wires arranged at the bottom of the water pan can fully melt remaining ice cubes, to prevent the remaining ice cubes from blocking the water outlet, thereby ensuring complete defrosting of the evaporator and improving the refrigeration efficiency of the evaporator.

Further, in the refrigerator of the present invention, the bottom of the water pan is divided into three areas from back to front: a first area, a second area and a third area, wherein the first area is close to the compressor chamber, the second area is located between the evaporator and the compressor chamber, and the third area is located below the evaporator. The first area is not provided with the compensation heating wires, but is attached with a thermally conductive material to conduct the heat of the compressor chamber. The second area is provided with the compensation heating wires with a first density, and the third area is provided with the compensation heating wires with a second density, wherein the first density is less than the second density. Different areas of the bottom of the water pan are provided with compensation heating wires with different densities corresponding to different heating requirements, and the heat of the compressor chamber is effectively used to realize energy conservation and environmental protection. The compensation heating wires arranged in the third area below the evaporator have a relatively high density, which can provide a large amount of heat and ensure that the remaining ice cubes are melted. Moreover, the bottom of the water pan is further divided into a fourth area, the fourth area is located on the front side of the water pan and close to the return air outlet, and the fourth area is provided with the compensation heating wires to avoid condensation and icing at the return air outlet and ensure smooth air return.

In the refrigerator of the present invention, the inner diameter of the end pipe section in the part of the drain pipe extending into the evaporating dish is 10% to 50% of the inner diameter of the extension pipe section thereabove, thereby reducing the size of the water outlet of the drain pipe, that is, reducing the inner diameter at the end of the drain pipe, which facilitates the sealing of the water outlet of the drain pipe, prevents the hot and humid air inside the compressor chamber from entering the cooling chamber, and reduces the possibility of severe icing at the bottom of the evaporator, so as to solve the problem of severe icing at the bottom of the evaporator and the problem that ice cubes can easily block the water outlet during defrosting.

Further, in the refrigerator of the present invention, the water outlet is arranged far away from the air supply fan, which can also avoid frosting or even freezing of the air supply fan.

Furthermore, in the refrigerator of the present invention, the floating body is arranged at the end of the water outlet, which can effectively seal the drain pipe.

In the refrigerator with a drain pipe according to the present invention, the drain pipe is installed at the water outlet of the water pan by means of the connecting seat attached to the outer side of the bottom of the water pan, so the installation and fixing structure is simple. In addition, the protective sheet (such as an aluminum foil) is attached to the connecting edge of the connecting seat and the water pan, which can prevent the foaming material from overflowing into the cooling chamber during foaming, thereby avoiding quality problems caused by the overflowing.

Further, in the refrigerator of the present invention, the upper section of the drain pipe is provided with a flange and an external thread on both sides of the partition plate respectively; the fixing ring is screwed with the external thread to press the partition plate between the flange and the fixing ring, which ensures that the drain pipe and the partition plate are reliably fixed; and a gasket is further arranged on the side of the flange opposite to the partition plate to prevent the foaming material from overflowing into the compressor chamber during foaming in the refrigerator body.

Specific embodiments of the present invention will be described in detail below with reference to the accompanying drawings, and those skilled in the art will better understand the above and other objectives, advantages and features of the present invention.

BRIEF DESCRIPTION OF THE DRAWINGS

Hereinafter, some specific embodiments of the present invention will be described in detail in an exemplary rather than restrictive manner with reference to the accompanying drawings. In the drawings, like reference numerals denote like or similar components or parts. Those skilled in the art should understand that these drawings are not necessarily drawn to scale. In the drawings.

DETAILED DESCRIPTION

Figure 1:
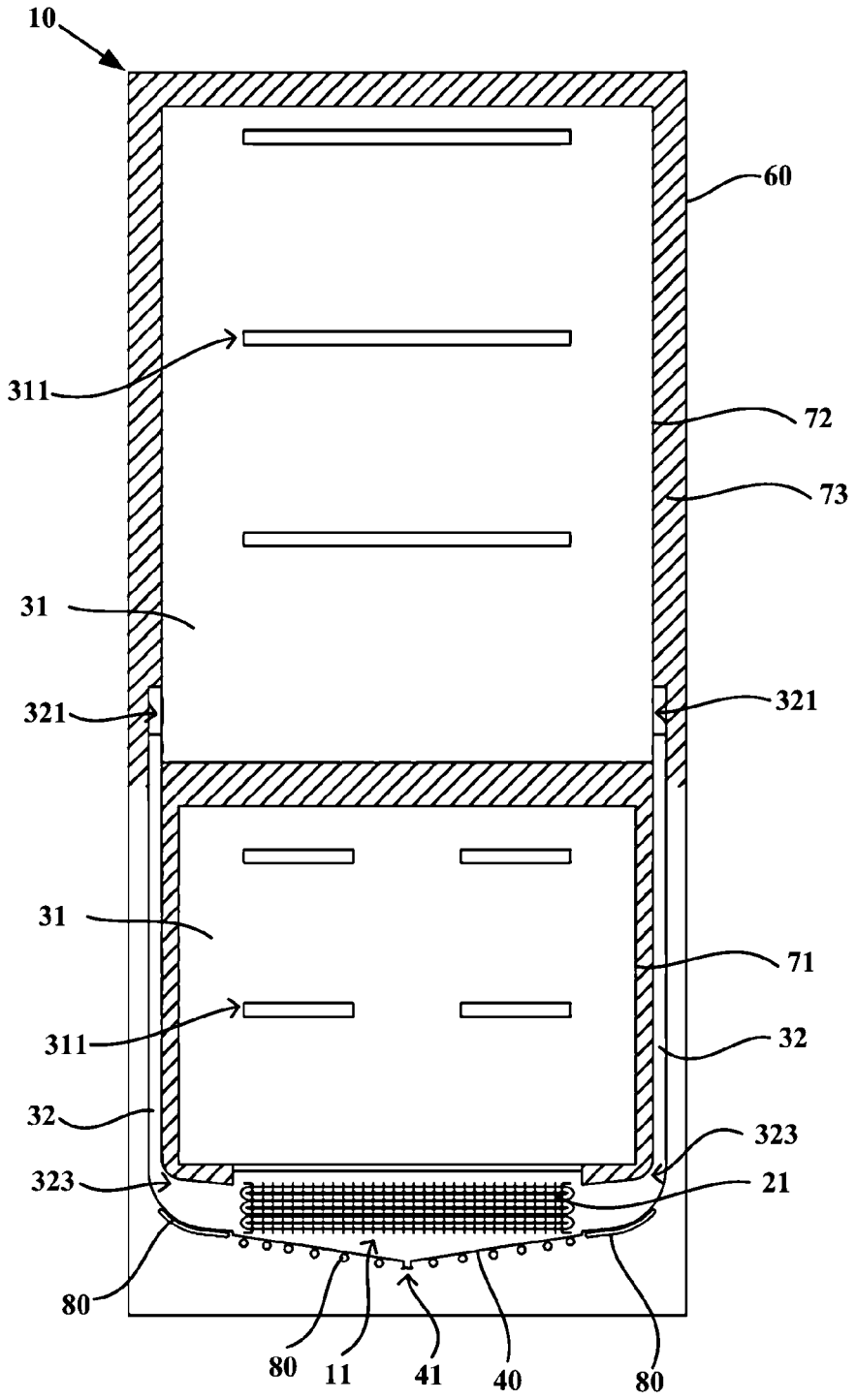
FIG. 1 is a front structure diagram of a refrigerator according to an embodiment of the present invention.
Figure 2:
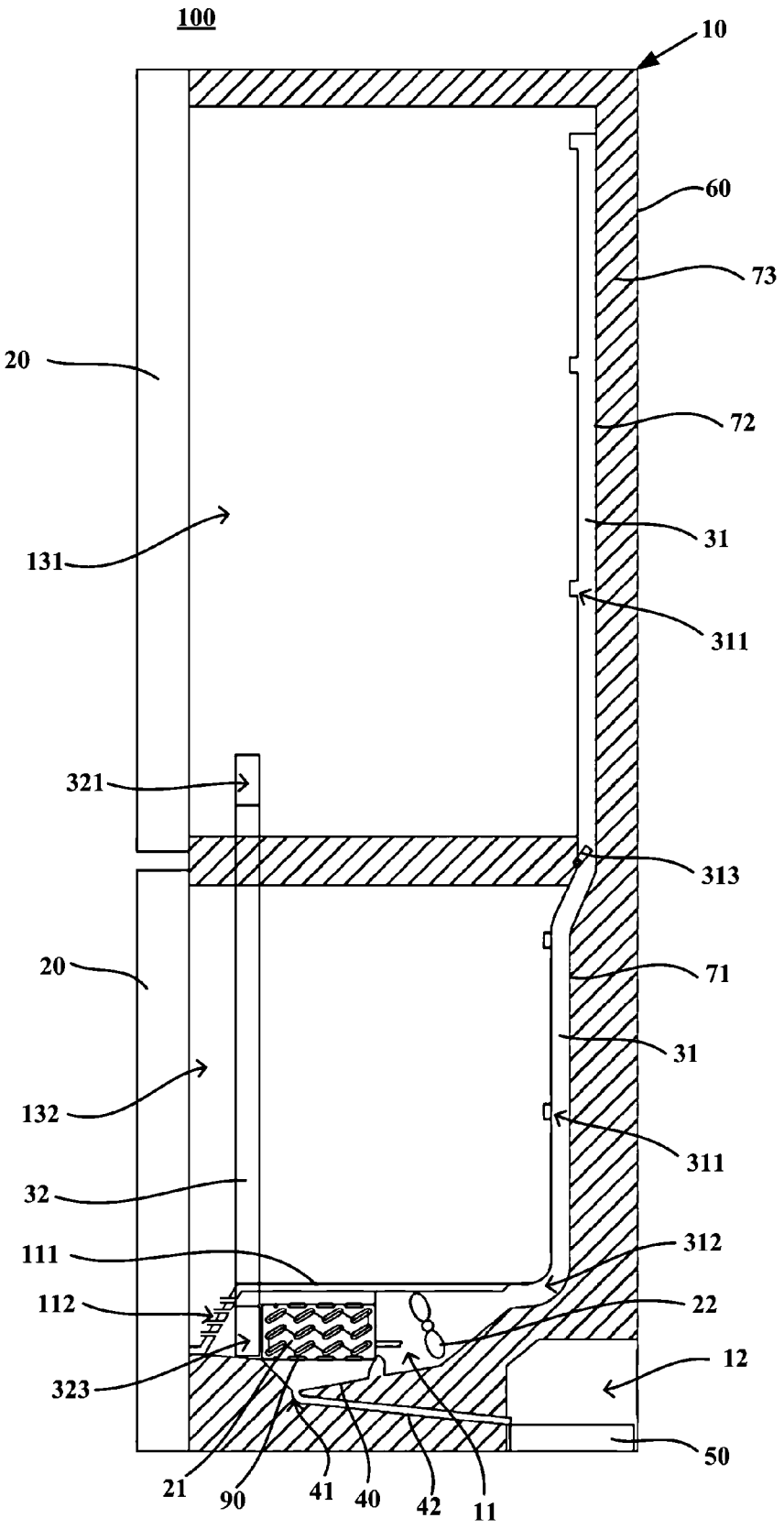
FIG. 2 is a side structure diagram of the refrigerator according to an embodiment of the present invention.
Figure 3:
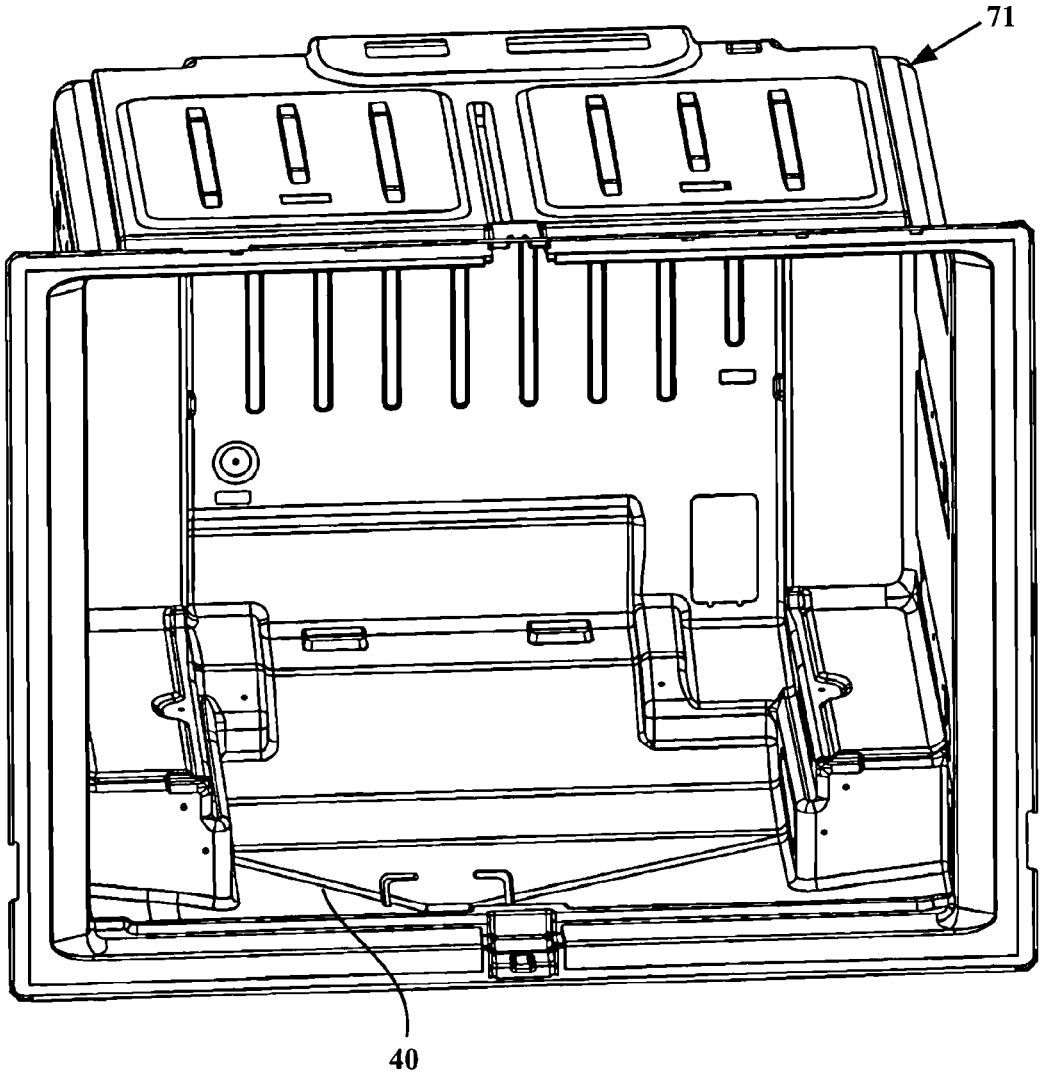
FIG. 3 is a structure diagram of a freezing liner in the refrigerator according to an embodiment of the present invention.
Figure 4:
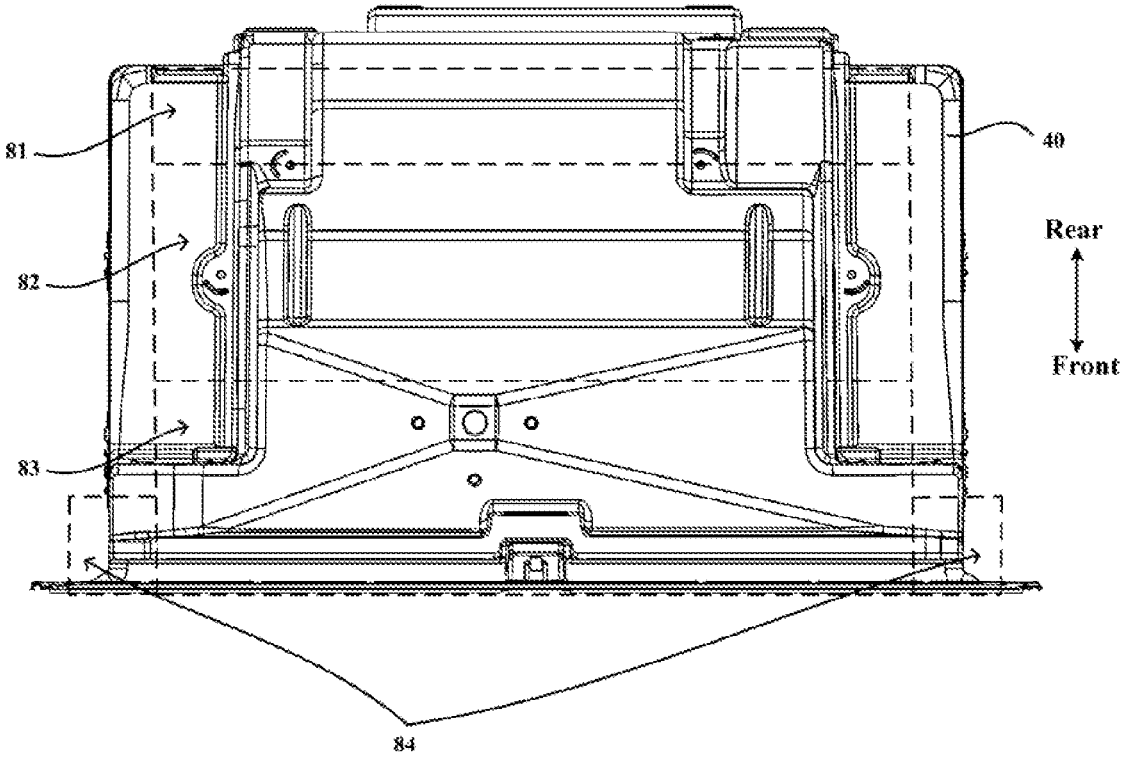
FIG. 4 is a bottom diagram of a water pan in the refrigerator according to an embodiment of the present invention.
Figure 5:
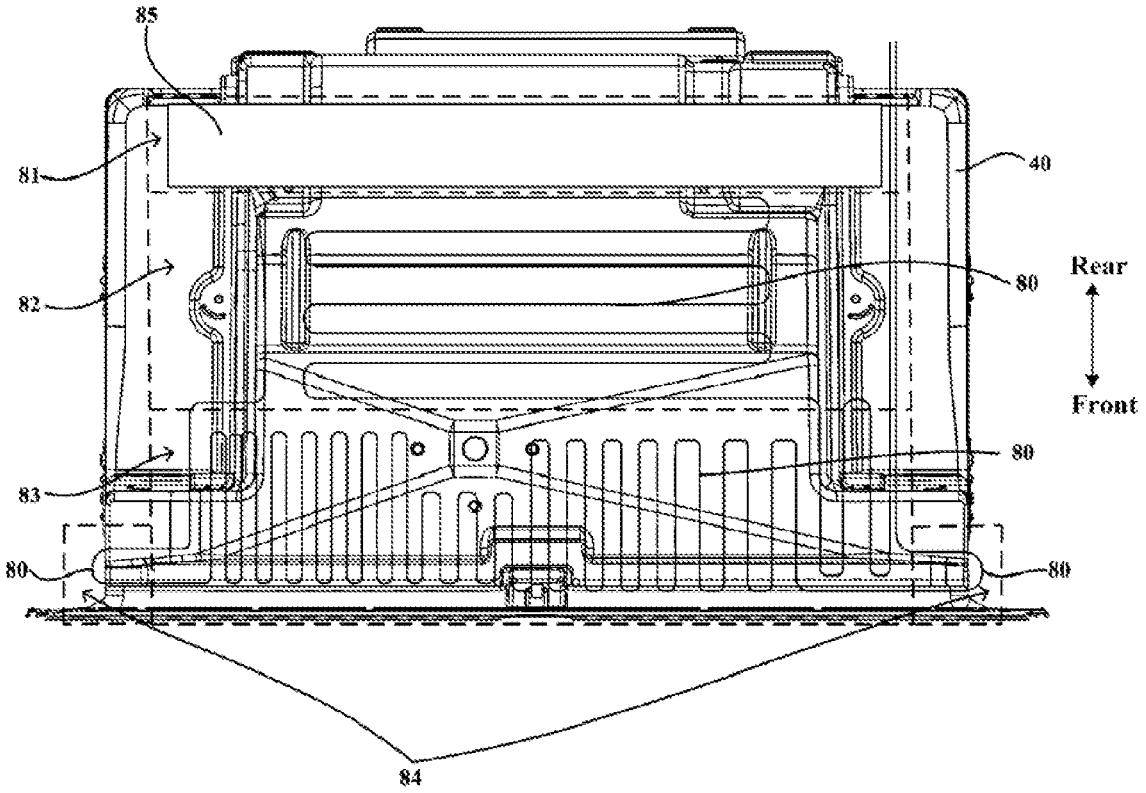
FIG. 5 is a distribution diagram of compensation heating wires at the bottom of the water pan in the refrigerator according to an embodiment of the present invention.

This embodiment provides a refrigerator. Compensation heating wires arranged at the bottom of a water pan can fully melt remaining ice cubes, to prevent the remaining ice cubes from blocking a water outlet, thereby ensuring complete defrosting of an evaporator and improving the refrigeration efficiency of the evaporator. FIG. 1 is a front structure diagram of a refrigerator 100 according to an embodiment of the present invention, FIG. 2 is a side structure diagram of the refrigerator 100 according to an embodiment of the present invention, FIG. 3 is a structure diagram of a freezing liner 71 in the refrigerator 100 according to an embodiment of the present invention, FIG. 4 is a bottom diagram of a water pan 40 in the refrigerator 100 according to an embodiment of the present invention, and FIG. 5 is a distribution diagram of compensation heating wires 80 at the bottom of the water pan 40 in the refrigerator 100 according to an embodiment of the present invention. As shown in FIGS. 1 to 5, the refrigerator 100 of this embodiment may generally include: a refrigerator body 10, door bodies 20 and an evaporator 21.

A cooling chamber 11 and at least one storage space are confined at the interior of the refrigerator body 10, and the cooling chamber 11 is arranged at the bottom of the refrigerator body 10 and below the storage space. As shown in FIGS. 1 and 2, the refrigerator 100 of this embodiment may include two storage spaces arranged from top to bottom: a first space 131 and a second space 132. The first space 131 and the second space 132 may be configured as a refrigeration space, a freezing space, a variable temperature space or a fresh-keeping space according to different uses. Each storage space may be partitioned into a plurality of storage areas by partition plates, and articles are stored therein by means of shelves or drawers.

The door bodies 20 are arranged on a front surface of the refrigerator body 10 to operably open and close the storage spaces. The door bodies 20 are arranged corresponding to the storage spaces, that is, each storage space corresponds to one or more door bodies 20. As shown in FIG. 2, the door bodies 20 can be pivotally arranged on the front surface of the refrigerator body 10. In some other embodiments, the door bodies 20 may be opened in a drawer manner, and drawer slide rails may be arranged at bottoms of the drawers to ensure a gentle effect during the opening and closing of the drawers and reduce noise.

The entire evaporator 21 is horizontally placed in the shape of a flat cube in the cooling chamber 11, and is configured to provide cold energy to the storage spaces. The entire evaporator 21 is horizontally placed in the shape of a flat cube in the cooling chamber 11, that is, the length-width surfaces of the evaporator 21 are parallel to the horizontal plane, and the thickness surface thereof is placed perpendicular to the horizontal plane. The cold energy provided by the evaporator 21 to various types of storage spaces is different, so that the temperatures in the various types of storage spaces are also different. For example, the temperature in the refrigeration space is generally between 2° C. and 10° C., preferably between 4° C. and 7° C. The temperature range in the freezing space is generally −22° C. to −14° C. The optimal storage temperatures for different types of articles are different, and the storage spaces suitable for storage of them are also different. For example, fruit and vegetable foods are suitable for storage in the refrigeration space or fresh-keeping space, while meat foods are suitable for storage in the freezing space.

As shown in FIGS. 1 to 3, a bottom wall of the cooling chamber 11 below the evaporator 21 is provided with a water pan 40 for receiving condensate water generated by the evaporator 21. In a preferred embodiment, as shown in FIG. 2, a front bottom wall and a rear bottom wall of the cooling chamber 11 are both inclined surfaces that are inclined downward along respective directions. The front bottom wall and the rear bottom wall of the cooling chamber 11 have certain included angles with the horizontal plane, so that the condensate water generated by the evaporator 21 can smoothly enter the water pan 40, and all the condensate water can be discharged, which effectively ensures the operational reliability of the evaporator 21.

A water outlet 41 is arranged at the junction of the front bottom wall and the rear bottom wall of the cooling chamber 11, and the water outlet 41 is located below the evaporator 21. The slope of the front bottom wall is greater than that of the rear bottom wall, so that the water outlet 41 is close to a front end of the evaporator 21 in the horizontal direction. Such that outside air can enter the cooling chamber 11 through the water outlet 41 and then pass through the evaporator 21 first, without directly forming undesirable phenomena such as frost and ice formation on a refrigeration fan 22.

It should be emphasized that, as shown in FIGS. 1 and 2, in addition to defrosting heating wires 90 arranged on the top and bottom of the evaporator 21, compensation heating wires 80 with different densities are arranged in different areas of the bottom of the water pan 40 in this embodiment. The defrosting heating wires 90 are used to heat the evaporator 21 to defrost the evaporator 21. In addition to the normal heating and defrosting of the evaporator 21, the compensation heating wires 80 can fully melt remaining ice cubes, to prevent the remaining ice cubes from blocking the water outlet 41, thereby ensuring complete defrosting of the evaporator 21 and improving the refrigeration efficiency of the evaporator 21.

As shown in FIG. 2, a compressor chamber 12 is also confined at the interior of the refrigerator body 10, and the compressor chamber 12 is arranged at the bottom of the refrigerator body 10 and located behind the cooling chamber 11. A condenser, a heat dissipation fan and a compressor may be arranged in the compressor chamber 12. The above-mentioned components are not shown in the figure because they are arranged inside the compressor chamber 12. In a specific embodiment, the refrigerator 100 may further include an evaporating dish 50 arranged below the condenser to evaporate the water in the evaporating dish 50 by means of the heat of the condenser, and the water is taken away by the heat dissipation fan for heat dissipation.

As shown in FIG. 2, the refrigerator 100 of this embodiment may further include: a drain pipe 42, one end of which is connected to the water outlet 41 of the water pan 40, and the other end of which is connected to the evaporating dish 50, to transfer the condensate water in the water pan 40 to the evaporating dish 50. Specifically, the drain pipe 42 is placed obliquely, with one end connected to the water outlet 41 being higher than the other end, and an included angle between the drain pipe 42 and the horizontal plane is greater than or equal to a preset angle. The inclined angle of the drain pipe 42 matches the inclined angle of the water pan 40, so that the condensate water in the water pan 40 can be discharged smoothly.

In a specific embodiment, the refrigerator 100 of this embodiment has a plurality of storage spaces, including a refrigeration space and at least one freezing space. As shown in FIGS. 1 and 2, the refrigerator body 10 may include: a refrigeration liner 72 and a freezing liner 71. The freezing liner 71 confines the cooling chamber 11 and the at least one freezing space above the cooling chamber 11 therein. A bottom wall of the freezing liner 71 as a bottom wall of the cooling chamber 11 is provided with the water pan 40. The refrigeration liner 72 is arranged above the freezing liner 71, and confines the refrigeration space therein. Specifically, the interior of the refrigeration liner 72 in this embodiment confines a first space 131 that can be configured as the refrigeration space, the interior of the refrigeration liner 71 confines a second space 132 and the cooling chamber 11, and the second space 132 can be configured as the freezing space. That is, the second space 132 of the refrigerator 100 in this embodiment is adjacently arranged above the cooling chamber 11, and the first space 131 is arranged above the cooling chamber 11 with a spacing from it.

In addition, the refrigerator body 10 may further include: a shell 60 and a foamed layer 73. The shell 60 is arranged outside the freezing liner 71 and the refrigeration liner 72. The foamed layer 73 is arranged between the shell 60 and the refrigeration liner 72 and freezing liner 71 to isolate the heat from the outside of the refrigerator 100.

As shown in FIGS. 2 and 3, the bottom wall of the freezing liner 71 as the bottom wall of the cooling chamber 11 is provided with the water pan 40. FIG. 4 shows the bottom of the water pan 40. As shown in FIG. 4, the bottom of the water pan 40 can be divided into three areas from back to front: a first area 81, a second area 82 and a third area 83, wherein the first area 81 is close to the compressor chamber 12, the second area 82 is located between the evaporator 21 and the compressor chamber 12, and the third area 83 is located below the evaporator 21. In a preferred embodiment, the first area 81 is not provided with any compensation heating wire 80, but is attached with a thermally conductive material 85 to conduct the heat of the compressor chamber 12. For example, the thermally conductive material 85 may be an aluminum foil, which can effectively improve the thermal conduction efficiency and improve the uniformity of heating.

The second area 82 is provided with the compensation heating wires 80 with a first density, and the third area 83 is provided with the compensation heating wires 80 with a second density, wherein the first density is less than the second density. Different areas of the bottom of the water pan 40 are provided with compensation heating wires 80 with different densities corresponding to different heating requirements, and the heat of the compressor chamber 12 is effectively used to realize energy conservation and environmental protection. The compensation heating wires 80 arranged in the third area 83 below the evaporator 21 have a relatively high density, which can provide a large amount of heat and ensure that the remaining ice cubes are melted.

As shown in FIGS. 1 and 2, the refrigerator 100 may further include: a return air duct 32, which is arranged on any side wall of the refrigeration liner 72 and the freezing liner 71, an upper end of which is provided with a return air inlet 321 communicated with the refrigeration space, and a lower end of which is provided with a return air outlet 323 communicated with the cooling chamber 11 to realize air return from the refrigeration space to the cooling chamber 11. Specifically, the return air inlet 321 is arranged at a front part of the side wall of the refrigeration liner 72, the return air outlet 323 is arranged at a front part of the side wall of the freezing liner 71 on the same side, and the return air outlet 323 is arranged on the side wall of the freezing liner 71 at the cooling chamber 11. The return air inlet 321 and the return air outlet 323 are arranged at the front parts of the side walls of the refrigeration liner 72 and the freezing liner 71, so that the cold energy inside the refrigeration space can fully cool the refrigeration space from back to front and then return to the cooling chamber 11 through the return air duct 32. In a preferred embodiment, two return air ducts 32 may be arranged, and they may be symmetrically arranged on two side walls of the refrigeration liner 72 and the freezing liner 71.

As shown in FIGS. 4 and 5, the bottom of the water pan 40 is further divided into a fourth area 84, the fourth area 84 is located on the front side of the water pan 40 and close to the return air outlet 323, and the fourth area 84 is provided with compensation heating wires 80. When the return air ducts 32 are symmetrically arranged on the two side walls of the refrigeration liner 72 and the freezing liner 71, the bottom of the water pan are divided into two fourth areas 84 corresponding to the return air outlets 323 on the two sides, and each fourth area 84 is provided with a compensation heating wire 80. The fourth area 84 is provided with the compensation heating wire 80 to avoid condensation and icing at the return air outlet 323 and ensure smooth air return.

As shown in FIGS. 1 and 2, the refrigerator 100 may further include an air supply duct 31, which is arranged on the inner sides of rear walls of the refrigeration liner 72 and the freezing liner 71 and has an air supply inlet 312 communicated with the cooling chamber 11 at a bottom end, and air supply outlets 311 arranged corresponding to the refrigeration space and the freezing space respectively to transfer the cold energy provided by the evaporator 21 to the storage spaces. Since the air supply outlet 311 is located at a rear side of each storage space, the cold energy in each storage space is transferred from the rear side to a front side.

In a preferred embodiment, as shown in FIG. 2, a refrigeration fan 22 may be further arranged on the rear side of the evaporator 21, the refrigeration fan 22 may be arranged forwardly on the rear side of the evaporator 21, and an air outlet direction of the refrigeration fan 22 may be directly opposite to the air supply inlet 312, so that the cold energy generated by the evaporator 21 smoothly enters the air supply duct 31. An air door 313 may be further arranged in the air supply duct 31, and the air door 313 is opened and closed in a controlled manner to adjust the cold energy entering the refrigeration space.

As shown in FIGS. 1 and 2, the refrigerator 100 may further include: an evaporator cover plate 111, which covers the evaporator 21, and serves as a top wall to confine the cooling chamber 11 together with the freezing liner 71. In a preferred embodiment, a front end of the evaporator cover plate 111 is provided with a freezing return air port 112 communicated with the freezing space, so as to realize air return from the freezing space to the cooling chamber 11. Specifically, the freezing return air port 112 may be in the shape of a louver. The second space 132 in this embodiment serves as a freezing space and is adjacently arranged above the cooling chamber 11, which can quickly return air to the cooling chamber 11 through the freezing air return port 112.

The refrigerator 100 of this embodiment includes: a refrigerator body 10, at the interior of which a cooling chamber 11 and at least one storage space are confined, wherein the cooling chamber 11 is arranged at the bottom of the refrigerator body 10 and below the storage space; door bodies 20 arranged on the front surface of the refrigerator body 10 to operably open and close the storage spaces; and an evaporator 21, which is wholly horizontally placed in the shape of a flat cube in the cooling chamber 11 and configured to provide cold energy to the storage space, wherein the bottom wall of the cooling chamber 11 below the evaporator 21 is provided with a water pan 40 to receive condensate water generated by the evaporator 21, and different areas of the bottom of the water pan 40 are provided with compensation heating wires 80 with different densities. In addition to the normal heating and defrosting of the evaporator 21, the compensation heating wires 80 arranged at the bottom of the water pan 40 can fully melt remaining ice cubes, to prevent the remaining ice cubes from blocking the water outlet 41, thereby ensuring complete defrosting of the evaporator 21 and improving the refrigeration efficiency of the evaporator 21.

Further, in the refrigerator 100 of this embodiment, the bottom of the water pan 40 is divided into three areas from back to front: a first area 81, a second area 82 and a third area 83, wherein the first area 81 is close to the compressor chamber 12, the second area 82 is located between the evaporator 21 and the compressor chamber 12, and the third area 83 is located below the evaporator 21. The first area 81 is not provided with any compensation heating wire 80, but is attached with a thermally conductive material 85 to conduct the heat of the compressor chamber 12. The second area 82 is provided with the compensation heating wires 80 with a first density, and the third area 83 is provided with the compensation heating wires 80 with a second density, wherein the first density is less than the second density. Different areas of the bottom of the water pan 40 are provided with compensation heating wires 80 with different densities corresponding to different heating requirements, and the heat of the compressor chamber 12 is effectively used to realize energy conservation and environmental protection. The compensation heating wires 80 arranged in the third area 83 below the evaporator 21 have a relatively high density, which can provide a large amount of heat and ensure that the remaining ice cubes are melted. Moreover, the bottom of the water pan 40 is further divided into a fourth area 84, the fourth area 84 is located on the front side of the water pan 40 and close to the return air outlet 323, and the fourth area 84 is provided with the compensation heating wires 80 to avoid condensation and icing at the return air outlet 323 and ensure smooth air return.

Refer to FIGS. 6 to 14 below.

Figure 6:
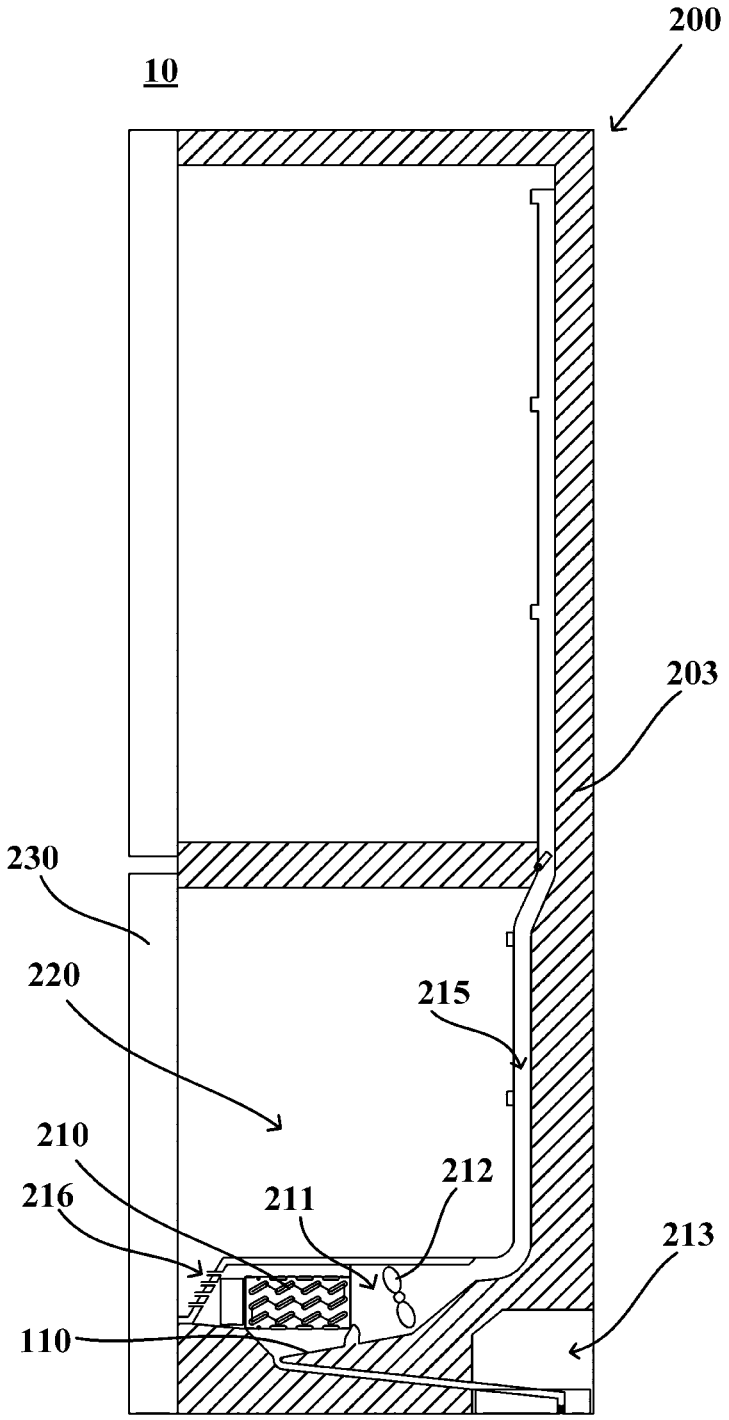
FIG. 6 is a side view of a refrigerator with a drain pipe according to an embodiment of the present invention.
Figure 7:
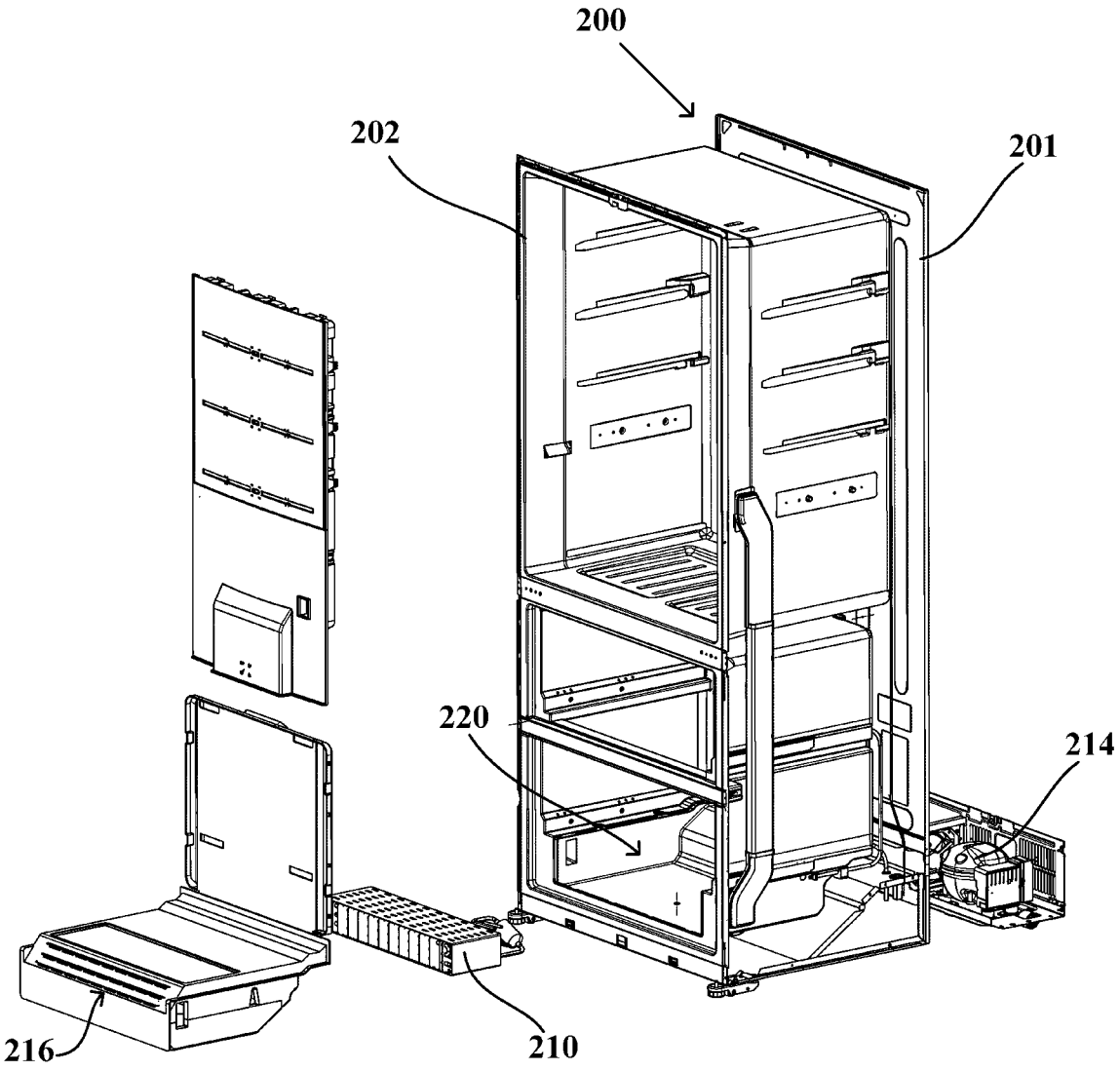
FIG. 7 is an exploded view of the refrigerator with a drain pipe according to an embodiment of the present invention.
Figure 8:
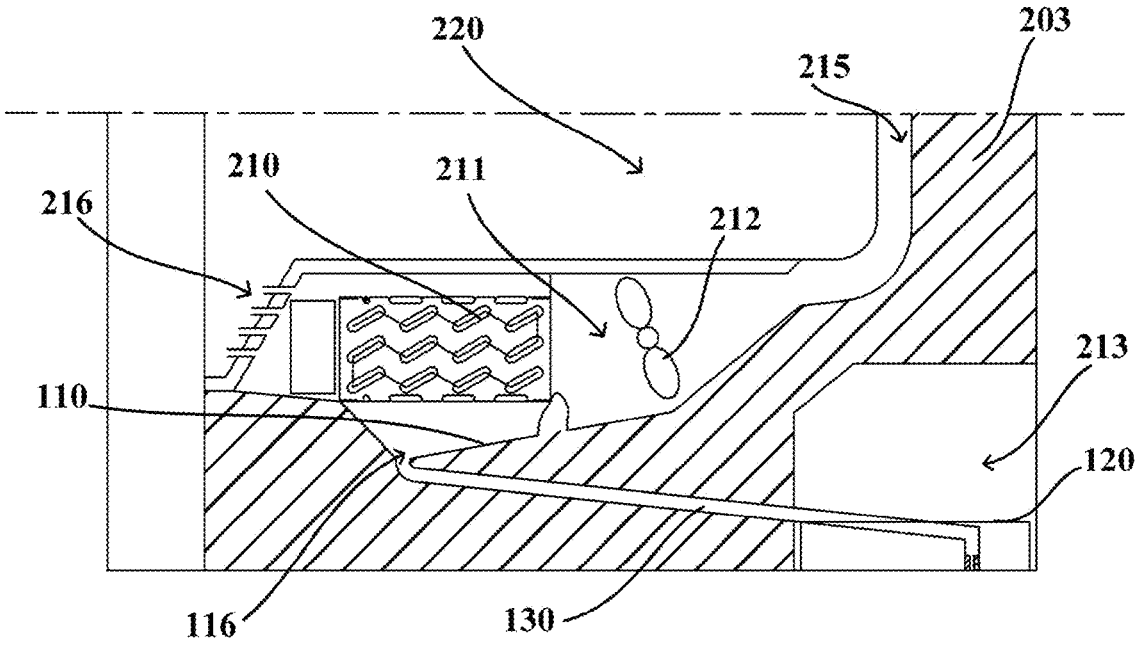
FIG. 8 is a side view of a lower part of the refrigerator with a drain pipe according to an embodiment of the present invention.

FIG. 6 is a side view of a refrigerator 10 with a drain pipe 130 according to an embodiment of the present invention, FIG. 7 is an exploded view of the refrigerator 10 with a drain pipe according to an embodiment of the present invention (in order to show the internal structure of the refrigerator 10, door bodies and a thermal insulation layer are hidden), and FIG. 8 is a side view of a lower part of the refrigerator 10 with a drain pipe according to an embodiment of the present invention. In the refrigerator 10 of this embodiment, the position of the evaporator 210 in a refrigeration system is changed from the rear part of a storage compartment 220 to the bottom of the storage compartment 220, and the vertical installation of the evaporator 210 is changed to horizontal placement, thereby increasing the height of the storage compartment 220 and facilitating user operation. Moreover, since the evaporator 210 is no longer arranged on the back, the utilization efficiency of the storage space of the refrigerator 10 is improved. In addition, a compressor 214 and the condenser are arranged at the lower rear part of the evaporator 210, so that the storage compartment 220 at the bottom is regular, and the space utilization rate of the storage space of the refrigerator 10 is improved.

The refrigerator 10 of this embodiment may include: a refrigerator body 200, door bodies 230, a refrigeration system, etc. The refrigerator body 200 includes: a refrigerator body housing 201, a storage liner 202, a thermal insulation layer 203, and other accessories. The refrigerator body housing 201 is an outer layer structure of the refrigerator 10 and protects the entire refrigerator 10. In order to isolate heat conduction with the outside, there is a thermal insulation layer 203 between the refrigerator body housing 201 and the storage liner 202, and the thermal insulation layer 203 may be formed by a foaming process.

The refrigerator body 200 confines at least one storage compartment 220 with an open front side, and usually confines a plurality of storage compartments, such as a refrigeration chamber, a freezing chamber, a variable-temperature chamber and so on. The number and functions of specific storage compartments 220 may be configured according to previous requirements. In this embodiment, the number and structure of the storage compartments 220 and the function of each storage compartment 220 may be configured according to specific conditions. Generally, the storage compartment 220 whose bottom is close to the evaporator 210 may be used as a freezing chamber.

The refrigerator body 200 may further confine a cooling chamber 211 for arranging the evaporator 210. The entire evaporator 210 is horizontally placed in the shape of a flat cube in the cooling chamber 211, that is, the length-width surfaces of the evaporator 210 are parallel to the horizontal plane, and the thickness surface thereof is placed perpendicular to the horizontal plane. The entire evaporator 210 is parallel to the ground, and its thickness is significantly smaller than the length and width of the evaporator 210.

The cooling chamber 211 is located at the inner bottom of the storage liner 202; and a compressor chamber 213 is further formed at a lower rear part of the storage liner 202. The compressor 214 and the condenser (not shown in the figures) are horizontally arranged at intervals in the compressor chamber 213. A heat dissipation fan (not shown in the figures) is arranged between the condenser and the compressor 214. The heat dissipation fan promotes the formation of a heat dissipation airflow flowing through the condenser and the compressor 214 to achieve heat dissipation.

The refrigeration system may be a refrigeration cycle system composed of the compressor 214, the condenser, a throttling device (not shown in the figures), the evaporator 210, etc. The evaporator 210 is configured to provide cold energy into the storage compartment 220, and the cold energy can be transferred through an air duct system, and air flow circulation is achieved through a fan. Since the refrigeration system itself is well-known and easy to implement by those skilled in the art, in order not to cover and obscure the invention of the present application, the working principle of the refrigeration system will not be described in detail below.

The air supply duct 215 may be arranged on the back of the storage liner 202, and has an air inlet arranged in the cooling chamber 211 and air supply ports respectively formed on the backs of the storage compartments 220, and an air supply fan 212 for forming refrigeration airflow is arranged at the air inlet. The refrigeration airflow is distributed by the air supply duct 215, so that the storage compartments 220 can reach respective set temperatures. The air supply fan 212 may be located in the cooling chamber 211 and obliquely arranged on the rear side of the evaporator 210.

The air supply fan 212 is obliquely arranged on the rear side of the evaporator 210, and the air supply fan 212 is in an inclined posture as a whole. As a result, the height space occupied by the air supply fan 212 is reduced, thereby reducing the height space occupied by the cooling chamber 211, and ensuring the storage volume of the storage compartment 220 above the cooling chamber 211.

A return airflow of the storage compartment 220 enters the cooling chamber 211 from a return air port 216 formed at the front part of the cooling chamber 211, and exchanges heat with the evaporator 210. During heat exchange, condensate water and frost may appear on the surface of the evaporator 210. Therefore, a heating device such as heating wires may be further arranged on the evaporator 210. When defrosting is required, the heating wires generate heat to melt the frost attached to the evaporator 210. The heating wires may be embedded in a channel formed by a plurality of fin notches of the evaporator 210, or may be integrally arranged on the top and bottom of the evaporator 210 to directly heat the evaporator 210, so as to improve the defrosting effect.

In order to smoothly discharge the condensate water or defrosted water, the bottom wall of the cooling chamber 211 may form a water pan 110 for receiving water dripping from the evaporator 210, and a water outlet 116 is formed at the bottom of the water pan 110. In some embodiments, the water pan 110 may be of a recessed structure arranged below the evaporator 210.

A recessed water pan 110 is formed below the evaporator 210, and the refrigerator 10 may further include an evaporating dish 120 and a drain pipe 130. The evaporating dish 120 is arranged at the bottom of the condenser in the compressor chamber 213 to evaporate the water in the evaporating dish 120 by means of the heat of the condenser, and to accelerate the efficiency of the evaporator 210 by means of the heat dissipation airflow.

The evaporating dish 120 is entirely arranged below the water pan 110. The drain pipe 130 is connected between the water outlet 116 and the evaporating dish 120, and is used to drain the water in the water pan 110 to the evaporating dish 120. There is a thermal insulation layer 203 between the cooling chamber 211 and the compressor chamber 213, and the drain pipe 130 can obliquely pass through the thermal insulation layer 203 and enter the compressor chamber 213. Water can flow into the evaporating dish 120 naturally by means of the inclination angle of the drain pipe 130. For example, the inclination angle of the drain pipe 130 may be set to be greater than or equal to 5° and less than or equal to 10° with the horizontal plane. The setting of the inclination angle considers both the drainage angle of the drain pipe 130 and the space compactness.

In order to prevent the position of the water outlet 116 from being close to the air supply fan 212, which may cause serious condensation or even freezing at the air supply fan 212, the water outlet 116 may be located below the front part of the evaporator 210, for example, a ratio of the horizontal distance between the water outlet 116 and the front end of the evaporator 210 to the horizontal distance between the water outlet 116 and the rear end of the evaporator 210 is greater than ⅙ and less than ½. For example, the ratio of the horizontal distance between the water outlet 116 and the front end of the evaporator 210 to the horizontal distance between the water outlet 116 and the rear end of the evaporator 210 may be ⅓, that is, the water outlet 116 is located below one third of the front part of the evaporator 210. As a result, the water outlet 116 is kept away from the air supply fan 212, and even if hot and humid air enters the cooling chamber 211 from the water outlet 116, condensation at the air supply fan 212 can be avoided.

Figure 9:
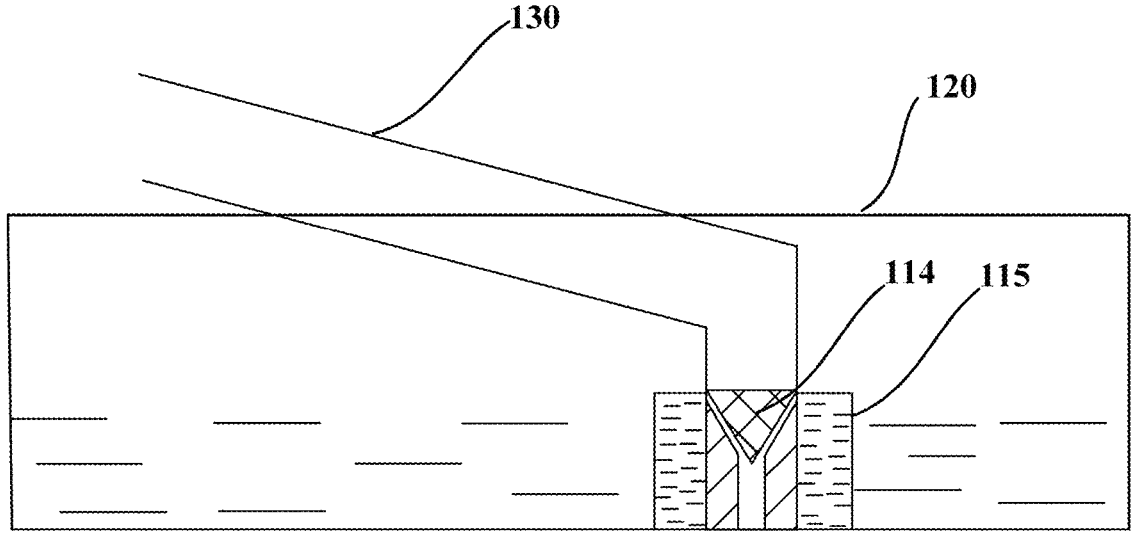
FIG. 9 is a schematic diagram of the part of the drain pipe extending into an evaporating dish in the refrigerator with a drain pipe according to an embodiment of the present invention.
Figure 10:
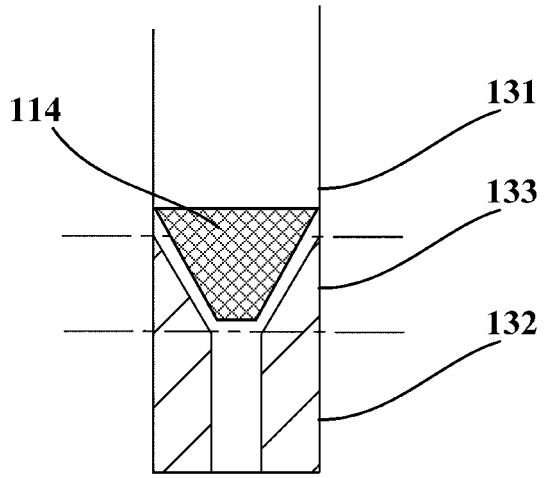
FIG. 10 is an enlarged view of the end of the drain pipe in the refrigerator with a drain pipe according to an embodiment of the present invention.

FIG. 9 is a schematic diagram of a part of the drain pipe 130 extending into the evaporating dish 120 in the refrigerator 10 with a drain pipe according to an embodiment of the present invention. FIG. 10 is an enlarged view of the end of the drain pipe 130 in the refrigerator 10 with a drain pipe according to an embodiment of the present invention.

Since the distance between the cooling chamber 211 and the compressor chamber 213 is relatively short in the refrigerator 10 of this embodiment, the hot and humid air in the compressor chamber 213 easily enters the cooling chamber 211 from the drain pipe 130, to form ice at the bottom of the evaporator 210. Compared with the air flow returned from the storage compartment 220, the hot and humid air in the compressor chamber 213 has a larger humidity and a higher temperature. Ice cubes formed in this way are not easily melted by the heating wires, and when the ice cubes fall to the water outlet 116, the water outlet 116 is blocked by ice, thus causing hidden dangers to the refrigeration performance and safety performance of the refrigerator 10.

Based on the above problems, the part of the drain pipe 130 extending into the evaporating dish 120 may include: an extension pipe section 131 and an end pipe section 132 connected to the extension pipe section 131 and located at the end of the drain pipe 130. The inner diameter of the end pipe section 132 is 10% to 50% of the inner diameter of the extension pipe section 131, thereby reducing the size of the water outlet of the drain pipe 130. In some more preferred embodiments, the inner diameter of the end pipe section 132 is 20% to 40%, for example, 30%, of the inner diameter of the extension pipe section 131. Such a proportional relationship can ensure the smooth discharge of water and, at the same time, facilitate the formation of a scaling structure such as a water seal. As the end pipe section 132 of the drain pipe 130 becomes thinner, under the condition that the condensate water or defrosted water can flow out normally, the flow area of the hot and humid air entering the cooling chamber 211 from the compressor chamber 213 can also be reduced.

There is also a transition pipe section 133 between the end pipe section 132 and the extension pipe section 131, and the inner diameter of the transition pipe section 133 is tapered in a drainage direction to form a funnel shape. The transition pipe section 133 avoids water accumulation on the top of the end pipe section 132, so that water can flow down naturally.

A floating body 114 is arranged in the extension pipe section 131 above the transition pipe section 133, and the shape of the bottom of the floating body 114 is adapted to the shape of the inner diameter of the transition pipe section 133. The density of the floating body 114 is less than that of water, so the floating body can rise by means of the buoyancy of water to open the transition pipe section 133. After the water level of the evaporating dish 120 increases, and the water enters the end of the drain pipe 130, the floating body 114 is lifted up to achieve water sealing. When the water level in the evaporating dish 120 is relatively low and no water flows down, the floating body 114 falls, to form a seal with the pipe wall of the transition pipe section 133.

The end pipe section 132 and the transition pipe section 133 may both be vertically arranged. A water storage portion 115 is formed at the bottom of the evaporating dish 120, and the end pipe section 132 is inserted into the water storage portion 115, so that the discharged water fills up the water storage portion 115 and then overflows into the evaporating dish 120. The entire end pipe section 132 is located in the water storage portion 115. The water level of the water storage portion 115 is higher than that of the evaporating dish 120, which can also achieve water sealing at the end of the drain pipe 130.

The structures of the above floating body 114 and water storage portion 115 can be selected and used according to needs. In some embodiments, only the floating body 114 or only the water storage portion 115 may be used. In other embodiments, the floating body 114 and the water storage portion 115 may be configured at the same time.

Figure 11:
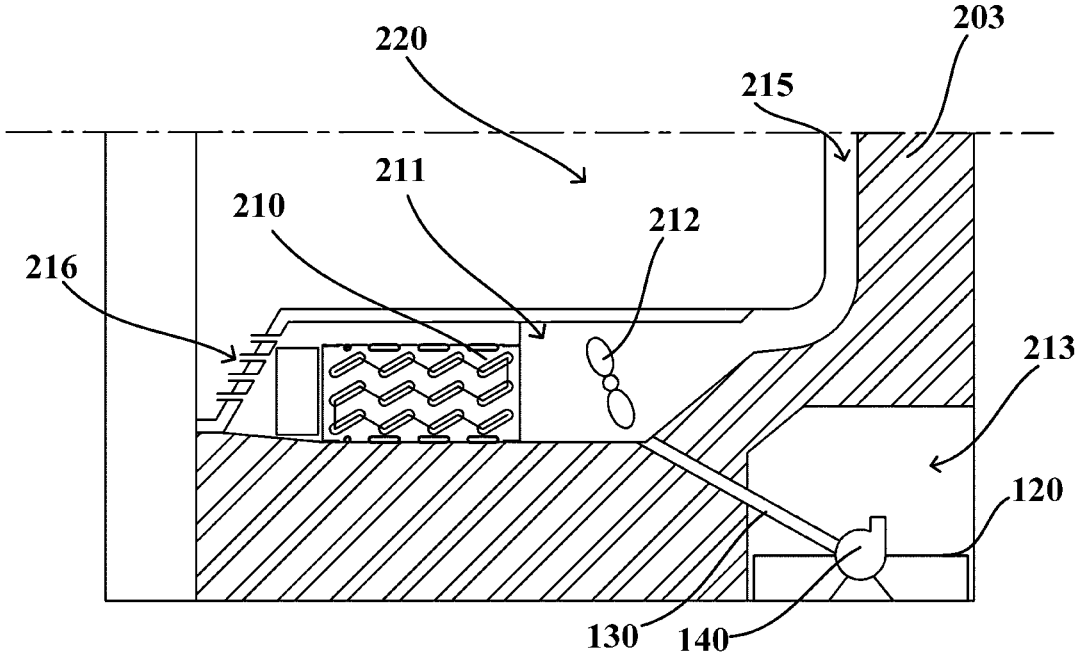
FIG. 11 is a side view of a lower part of the refrigerator with a drain pipe according to another embodiment of the present invention.

FIG. 11 is a side view of a lower part of the refrigerator 10 with a drain pipe according to another embodiment of the present invention. The refrigerator 10 may also be provided with a drain pump 140, and the drain pump 140 is connected to the drain pipe 130 to pump the water in the water pan 110 into the evaporating dish 120. The drain pump 140 may be installed in the evaporating dish 120 and turned on when water needs to be pumped (for example, when defrosting). During normal operation, the drain pump 140 is closed, and the drain pipe 130 can be closed to prevent the hot and humid air from entering the cooling chamber 211.

When the drain pump 140 is used, the water pan 110 below the evaporator 210 may be a flat surface or the water pan 110 is canceled directly. When the evaporator 210 is defrosted, defrosted water accumulates on the bottom wall of the cooling chamber 211. After the defrosting ends (or during the defrosting process), the drain pump 140 is turned on, and the defrosted water flows into the evaporating dish 120 through the drain pipe 130 and the drain pump 140.

This structure can ensure that the bottom of the evaporator 210 and fan blades are not frosted. The water pan 110 at the bottom of the evaporator 210 may be made into a flat surface or a surface with a small inclination angle, which can reduce the mold cost and process cost of the refrigerator 10.

Figure 12:
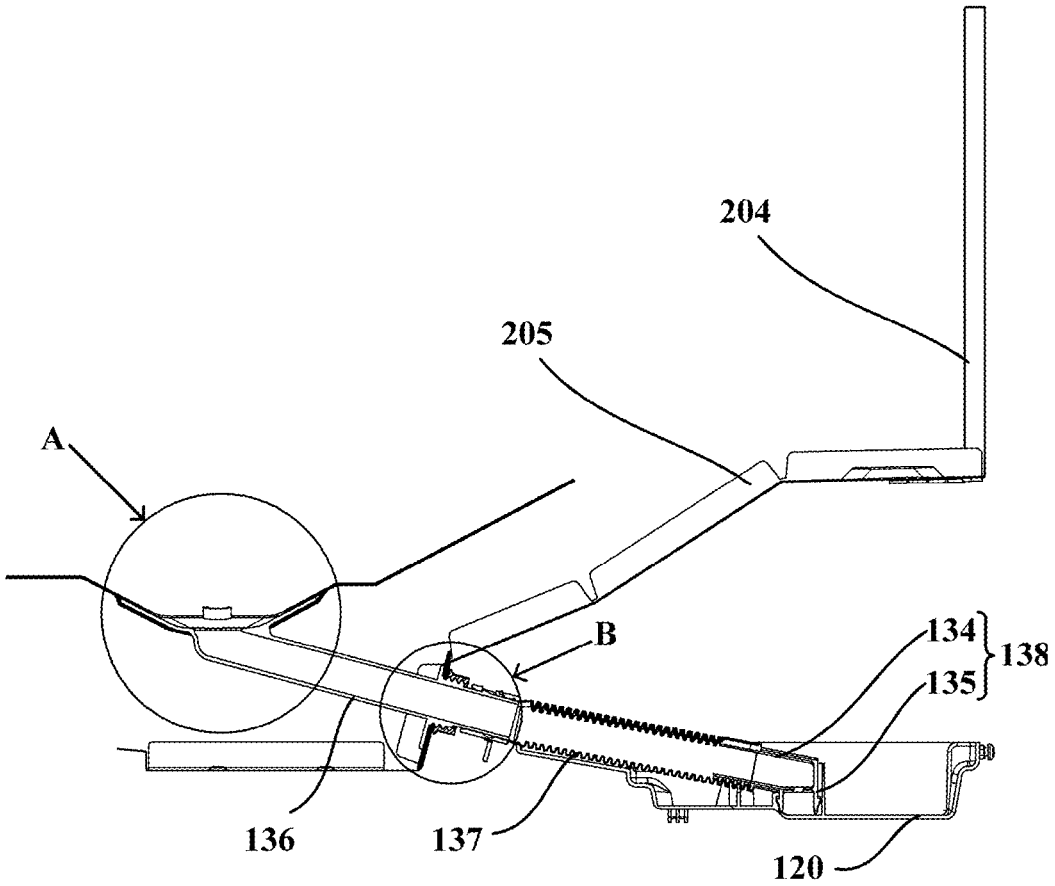
FIG. 12 is a schematic diagram of a drainage system in the refrigerator with a drain pipe according to an embodiment of the present invention.
Figure 13:
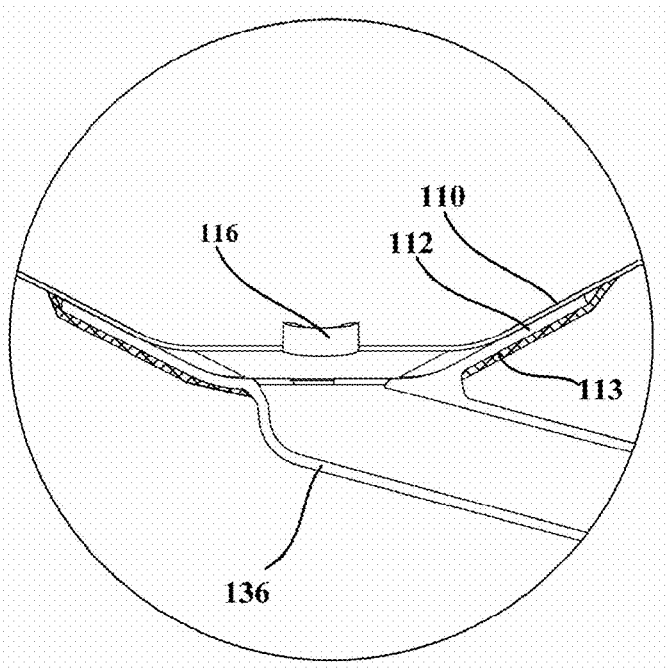
FIG. 13 is a partial enlarged view of A in FIG. 12.
Figure 14:
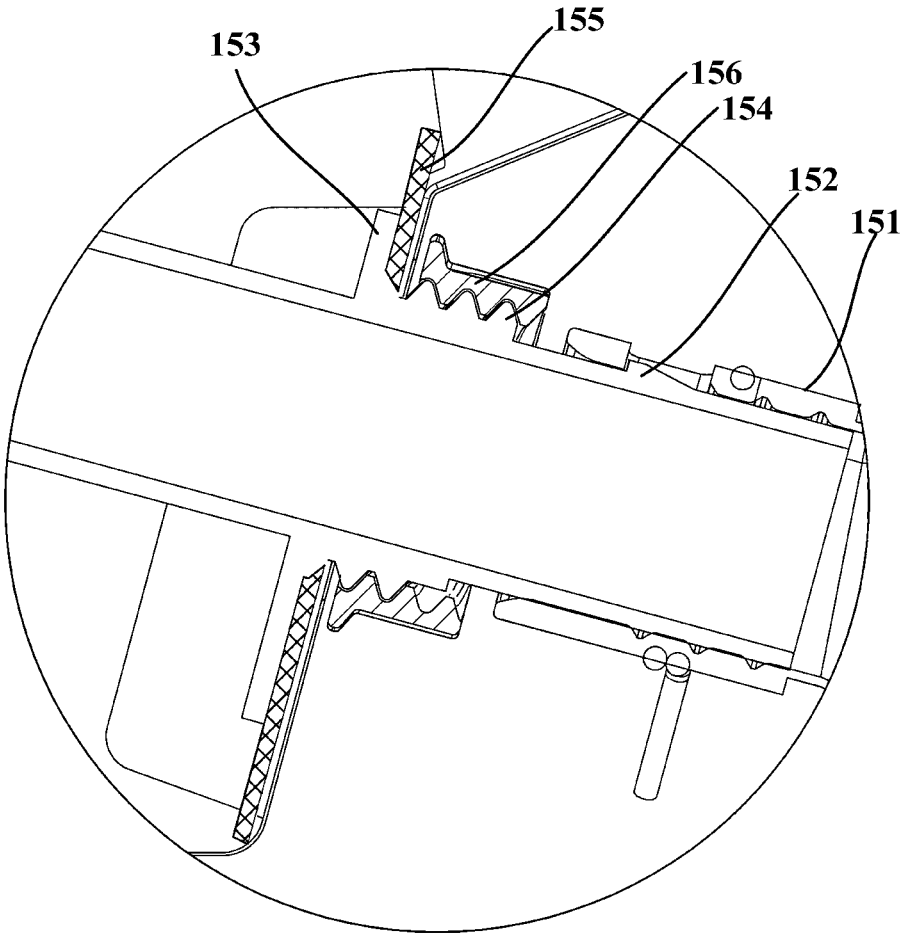
FIG. 14 is a partial enlarged view of B in FIG. 12.

FIG. 12 is a schematic diagram of a drainage system in the refrigerator 10 with a drain pipe according to an embodiment of the present invention, FIG. 13 is a partial enlarged view of A in FIG. 12, and FIG. 14 is a partial enlarged view of B in FIG. 12. The refrigerator body 200 may further include a back 204 located at the rear side of the storage liner 202, and the back 204 serves as a part of the refrigerator body housing 201. A partition plate extends obliquely forward from the back 204 to form a top wall of the compressor chamber 213. The partition plate may also be referred to as a bottom cylinder, the upper side of which is used for foaming to form the thermal insulation layer 203, and the lower side of which confines the compressor chamber 213.

The refrigerator 10 of this embodiment may further be provided with a connecting seat 112 and a protective sheet 113. The connecting seat 112 is attached to the outer side of the bottom of the water pan 110, and connected with the drain pipe 130 at a position opposite to the water outlet 116, to guide the water in the water pan 110 to the evaporating dish 120 by means of the drain pipe 130. Because the drain pipe 130 is installed at the water outlet 116 of the water pan 110 by means of the connecting seat 112 attached to the outer side of the bottom of the water pan 110, the installation and fixing structure is simple and reliable. The protective sheet 113 is attached to a connecting edge of the connecting seat 112 and the water pan 110 to prevent the foaming material from overflowing into the cooling chamber 211 during foaming in the refrigerator body 200, thereby avoiding quality problems caused by the overflowing.

The shape of the side of the connecting seat 112 facing the water pan 110 is adapted to the bottom of the water pan 110, for example, a disk shape. The protective sheet 113 may be made of an aluminum foil and attached to the connecting edge of the connecting seat 112 and the water pan 110.

The drain pipe 130 of the refrigerator 10 in this embodiment may also be a hose, which can be bent and squeezed to a certain extent. Two ends of the hose are connected to the water pan 110 and the compressor chamber 213 respectively. The hose can be deformed to compensate for the position deviation of installation, so as to reduce installation difficulty. For example, the drain pipe 130 may include an upper section 136, a bellows section 137, and a lower section 138. An upper end of the upper section 136 is fixed to the connecting seat 112 and the upper section extends obliquely downward through the thermal insulation layer 203 between the cooling chamber 211 and the compressor chamber 213, that is, the upper section 136 serves as a pipe section connected to the connecting seat 112. An upper end of the bellows section 137 is connected to a lower end of the upper section 136 and the bellows section extends to the evaporating dish 120. The lower section 138, an upper end of which is connected to a lower end of the bellows section 137, is used for draining water into the evaporating dish 120. Therefore, the bellows section 137 reduces the installation difficulty.

The bellows section 137 may be replaced by a pipe fitting that is subjected to bending deformation to a certain extent or tensile deformation in the length direction thereof or compression deformation in the length direction thereof.

The upper end of the bellows section 137 is provided with a bayonet 151, and the lower end of the upper section 136 is provided with a chuck 152. After the upper end of the bellows section 137 is sleeved on the lower end of the upper section 136, the chuck 152 is engaged with the bayonet 151, so that the bellows section 137 is engaged with the upper section 136. The bellows section 137 is fixed by an engaging structure, so the installation is simple and the fixation is reliable.

The upper section 136 is provided with a flange 153 and an external thread 154 on both sides of the partition plate respectively; and a fixing ring 156 is arranged at the external thread 154 in a matching manner, and the fixing ring 156 is screwed with the external thread 154 to press the partition plate between the flange 153 and the fixing ring 156. A gasket 155 is further arranged on the side of the flange 153 opposite to the partition plate to prevent the foaming material from overflowing into the compressor chamber 213 during foaming in the refrigerator body 200. During the screwing process of the fixing ring 156, the gasket 155 is compressed. During the foaming process, the gasket 155 can block the foaming material.

The lower section 138 may include: an inclined connecting section 134 and a vertical water outlet section 135. The inclined connecting section 134 is connected to the lower end of the bellows section 137 and extends along the length of the bellows section 137; the vertical water outlet section 135 is connected to a lower end of the inclined connecting section 134 and is used for guiding water into the evaporating dish 120 vertically. Because the vertical water outlet section 135 is arranged vertically, the water outlet direction in the drain pipe 130 is vertically downward, which facilitates water exit and produces a water seal.

On the one hand, the structure of the drain pipe 130 compensates for the installation deviation by means of the deformation of the bellows section 137, which reduces the installation difficulty; on the other hand, the structure of the drain pipe can prevent the foaming material from overflowing into the cooling chamber 211 and the compressor chamber 213, which improves the production quality.

So far, those skilled in the art should realize that although multiple exemplary embodiments of the present invention are illustrated and described in detail herein, many other variations or modifications that conform to the principle of the present invention may still be directly determined or derived from the disclosure of the present invention without departing from the spirit and scope of the present invention. Therefore, the scope of the present invention should be understood and deemed to cover all these other variations or modifications.

What is claimed is:

1. A refrigerator, comprising:

a refrigerator body, at an interior of which a cooling chamber and at least one storage space are confined, the cooling chamber being arranged at a bottom of the refrigerator body and below the at least one storage space;

door bodies, arranged on a front surface of the refrigerator body to operably open and close the at least one storage space; and an evaporator, wholly horizontally placed in a shape of a flat cube in the cooling chamber and configured to provide cold energy to the at least one storage space, wherein a bottom wall of the cooling chamber below the evaporator is provided with a water pan for receiving condensate water generated by the evaporator, wherein compensation heating wires are arranged at a bottom of the water pan, wherein a water outlet is formed at the bottom of the water pan and below the evaporator;

wherein a compressor chamber is confined at the interior of the refrigerator body, the compressor chamber being arranged at the bottom of the refrigerator body and located behind the cooling chamber, wherein the water outlet is closer to a front end of the evaporator than a rear end of the evaporator in a horizontal direction, and a projection of the evaporator on a horizontal plane is in front of a projection of the compressor chamber on the horizontal plane, wherein the bottom of the water pan is divided into three areas from back to front: a first area, a second area and a third area, wherein the first area is closer to the compressor chamber than the second area and the third area, the second area is located between the evaporator and the compressor chamber, and the third area is located below the evaporator;

wherein the first area is not provided with the compensation heating wires, but is attached with a thermally conductive material to conduct heat of the compressor chamber;

wherein the second area is provided with the compensation heating wires with a first density, and wherein the third area is provided with the compensation heating wires with a second density, wherein the first density is less than the second density.

2. The refrigerator according to claim 1, wherein there are a plurality of storage spaces, comprising a refrigeration space and at least one freezing space, and the refrigerator body comprises: a freezing liner, at the interior of which the cooling chamber and the at least one freezing space above the cooling chamber are confined, wherein a bottom wall of the freezing liner as the bottom wall of the cooling chamber is provided with the water pan; and a refrigeration liner, which is arranged above the freezing liner, and at the interior of which the refrigeration space is confined.

3. The refrigerator according to claim 2, further comprising:

a return air duct, which is arranged on side wall of at least one of the refrigeration liner or the freezing liner, an upper end of the return air duct being provided with a return air inlet communicated with the refrigeration space, and a lower end of the return air duct being provided with a return air outlet communicated with the cooling chamber to realize air return from the refrigeration space to the cooling chamber.

4. The refrigerator according to claim 3, wherein the bottom of the water pan is further divided into a fourth area, wherein the fourth area is located on a front side of the water pan and closer to the return air outlet than the first area, the second area, and the third area, and wherein the fourth area is provided with the compensation heating wires.

5. The refrigerator according to claim 2, further comprising:

an air supply duct, which is arranged on inner sides of rear walls of the refrigeration liner and the freezing liner and has an air supply inlet communicated with the cooling chamber at its bottom end, and air supply outlets arranged corresponding to the refrigeration space and the at least one freezing space respectively to transfer the cold energy provided by the evaporator to the at least one storage spaces; and an evaporator cover plate, which covers the evaporator, and serves as a top wall to confine the cooling chamber together with the freezing liner, wherein a front end of the evaporator cover plate is provided with a freezing return air port communicated with the at least one freezing space, so as to realize air return from the at least one freezing space to the cooling chamber.

6. The refrigerator according to claim 1, wherein the refrigerator further comprises:

an evaporating dish, arranged below the water pan; and a drain pipe, connected between the water outlet and the evaporating dish and used for guiding water in the water pan to the evaporating dish, wherein a part of the drain pipe extending into the evaporating dish includes an extension pipe section and an end pipe section connected to the extension pipe section and located at an end of the drain pipe, and an inner diameter of the end pipe section is 10% to 50% of an inner diameter of the extension pipe section, thereby reducing the size of the water outlet of the drain pipe.

7. The refrigerator according to claim 6, wherein the drain pipe further comprises a transition pipe section between the end pipe section and the extension pipe section, and wherein an inner diameter of the transition pipe section is tapered in a drainage direction to form a funnel shape.

8. The refrigerator according to claim 7, wherein a floating body is arranged in the extension pipe section above the transition pipe section, a shape of a bottom of the floating body is adapted to a shape of the inner diameter of the transition pipe section, and a density of the floating body is less than that of water, so that the floating body rises by means of buoyancy of water to open the transition pipe section;

the end pipe section and the transition pipe section are both vertically arranged.

9. The refrigerator according to claim 6, wherein a water storage portion is formed at a bottom of the evaporating dish, and the end pipe section is inserted into the water storage portion, so that discharged water fills up the water storage portion and then overflows into the evaporating dish; and the refrigerator further comprises:

a drain pump, connected to the drain pipe to pump water in the water pan into the evaporating dish; wherein the refrigerator body includes a storage liner, and the cooling chamber is located at an inner bottom of the storage liner;

the compressor chamber is formed at a lower rear part of the storage liner, and the evaporating dish is arranged in the compressor chamber; and there is a thermal insulation layer between the cooling chamber and the compressor chamber, and the drain pipe obliquely passes through the thermal insulation layer and enters the compressor chamber.

10. The refrigerator according to claim 6, wherein the refrigerator further comprises: an air supply fan, located in the cooling chamber and obliquely arranged on a rear side of the evaporator, wherein the water outlet is located below a front part of the evaporator; and a ratio of a horizontal distance between the water outlet and a front end of the evaporator to a horizontal distance between the water outlet and a rear end of the evaporator is greater than ⅙ and less than ½.

11. The refrigerator according to claim 1, wherein the refrigerator further comprises:

an evaporating dish, arranged below the water pan;

a connecting seat, attached to an outer side of the bottom of the water pan, and connected with a drain pipe at a position opposite to the water outlet, wherein the drain pipe is used for guiding water in the water pan to the evaporating dish; and a protective sheet, attached to a connecting edge of the connecting seat and the water pan to prevent a foaming material from overflowing into the cooling chamber during foaming in the refrigerator body.

12. The refrigerator according to claim 11, wherein a shape of the side of the connecting seat facing the water pan is adapted to the bottom of the water pan; and the protective sheet is made of an aluminum foil and attached to the connecting edge of the connecting seat and the water pan.

13. The refrigerator according to claim 11, wherein the refrigerator body comprises a storage liner, and the cooling chamber is located at an inner bottom of the storage liner;

the compressor chamber is formed at a lower rear part of the storage liner, and the evaporating dish is arranged in the compressor chamber;

the drain pipe obliquely passes through a thermal insulation layer between the cooling chamber and the compressor chamber; the drain pipe comprises:

an upper section, an upper end of the upper section being fixed to the connecting seat and the upper section extending obliquely downward through the thermal insulation layer between the cooling chamber and the compressor chamber;

a bellows section, an upper end of the bellows section being connected to a lower end of the upper section and the bellows section extending to the evaporating dish; and a lower section, an upper end of the lower section being connected to a lower end of the bellows section, and the lower section being used for draining water into the evaporating dish; wherein the lower section comprises:

an inclined connecting section, connected to the lower end of the bellows section and extending along a length of the bellows section, and a vertical water outlet section, connected to a lower end of the inclined connecting section and used for guiding water into the evaporating dish vertically.

14. The refrigerator according to claim 13, wherein the refrigerator body further comprises:

a back, located at a rear side of the storage liner; and a partition plate, extending obliquely forward from the back to form a top wall of the compressor chamber; the upper section passing out of a through hole of the partition plate and entering the compressor chamber, wherein the upper end of the bellows section is provided with a bayonet, the lower end of the upper section is provided with a chuck, and after the upper end of the bellows section is sleeved on the lower end of the upper section, the chuck is engaged with the bayonet, so that the bellows section is engaged with the upper section;

the upper section is provided with a flange and an external thread on both sides of the partition plate respectively; a fixing ring is arranged at the external thread in a matching manner, and the fixing ring is screwed with the external thread to press the partition plate between the flange and the fixing ring; and a gasket is further arranged on a side of the flange opposite to the partition plate to prevent the foaming material from overflowing into the compressor chamber during foaming in the refrigerator body.

* * * * *